US006041812A

United States Patent [19]

Hilbers

[11] Patent Number: 6,041,812

[45] Date of Patent: Mar. 28, 2000

[54] REGULATOR PROTECTOR

[76] Inventor: Eugene A. Hilbers, 1325 Ave. N, Scottsbluff, Nebr. 69361

[21] Appl. No.: 09/379,482

[22] Filed: Aug. 23, 1999

Related U.S. Application Data

[60] Provisional application No. 60/099,332, Sep. 8, 1998.

[51] Int. Cl.[7] ..... F16K 27/08

[52] U.S. Cl. ..... 137/382; 137/377

[58] Field of Search ..... 137/382, 377, 137/557

[56] References Cited

U.S. PATENT DOCUMENTS 2,529,254 11/1950 Ives ..... 137/377
4,625,949 12/1986 Walker .
4,802,502 2/1989 Williams ..... 137/382
5,071,148 12/1991 Salvucci, Sr. .
5,381,902 1/1995 Dumser et al. ..... 137/377
5,529,089 6/1996 Hicks et al. ..... 137/382

*Primary Examiner*—A. Michael Chambers
*Assistant Examiner*—Thomas L. McShane
*Attorney, Agent, or Firm*—Ancel W. Lewis, Jr.

[57] ABSTRACT

A regulator protector for one or more pressurized tanks such as oxygen and fuel gas cylinders disclosed includes a housing mounted to a support on a transport vehicle that carries one or more regulators. Flow lines are connected to the regulators and extend through the housing and are connected to one or more pressurized tanks supported on the transport vehicle a distance from the regulators to enable the regulators to not be mounted directly on the tanks in the normal manner and allow the pressure on the regulators to be reduced from the cylinder pressure to a working pressure during transport.

16 Claims, 2 Drawing Sheets

REGULATOR PROTECTOR

This application claims the benefit under 35 U.S.C. § 119(*e*) of the U.S. provisional patent application Ser. No. 60/099,332 filed Sep. 8, 1998.

TECHNICAL FIELD

This invention relates to pressurized tanks and more particularly to the safe transport of pressurized tanks commonly known as cylinders and typically used in the welding and cutting trade.

BACKGROUND ART

In the past, all portable welding trucks carry at lease one oxygen and one fuel gas cylinder to be used in the trade of welding and cutting. Attached to the oxygen cylinder is an oxygen regulator. Attached to the fuel gas cylinder, which is an acetylene or propane tank, is a fuel gas regulator. The purpose of the regulator is to reduce the cylinder pressure to a working pressure usable for applicable processes—oxygen 2700 PSI reduced to 50–70 PSI, fuel gas 300 PSI reduced to 5–10 PSI. The fuel gas, either acetylene or propane (flammable or explosive), creates a flame from a spark or a flame and causes a burn. The oxygen, on the other hand, is noncombustible but supports or enhances a flame or spark.

Both oxygen and fuel gas regulators need to be protected at all times. When attached to the cylinders, they are subject to falls and collision damages. It is common for the inlet fitting of the regulator (¼" threaded brass) to be broken off the regulator. If this happens, full cylinder pressure exhausts from the valve of the cylinder which, when full, is 2250 PSI at 70° on the oxygen side and as much as 300 PSI on the fuel gas side. If there is a spark or flame, such as in a collision, oxygen supports this cause of action and accelerates this situation to intolerable circumstances, and the best of fire departments cannot deal with it.

Some states have adopted a policy already that the regulators cannot be attached to the cylinders in transit. They must be removed. In any case, there is nowhere for the cylinder regulators to go, except on the floor of the truck, where they are subject to dirt, grease guns and old oil cans. You should never allow oxygen components to come in contact with grease or oil, as these products contain carbon and become very unstable after they are compressed more than 18 PSI.

Walker No. 4,625,949 discloses a cabinet assembly having mounts for rigidly supporting regulators within the cabinet with passageways permitting hoses from the cylinders to extend into and be connected to the input line of the regulators.

Salvucci, Ser. No. 5,071,148 discloses a cart having a guard structure which protects the valve and gauge assembly from damage when separated from the cylinder.

DISCLOSURE OF THE INVENTION

A regulator protector for one or more pressurized tanks is disclosed. A regulator protector includes a housing that mounts on a support on the transport vehicle and has the regulator removed from the top of the pressurized tank and is mounted inside the housing. An elongated flexible hose of a selected length connects from the valve inlet flow line on the regulator to the pressurized tank located a distance from the regulator and carried by the transport vehicle.

BRIEF DESCRIPTION OF THE DRAWINGS

Details of this invention are described in connection with the accompanying drawings which like parts bear similar reference numerals in which.

DETAILED DESCRIPTION

Figure 1:
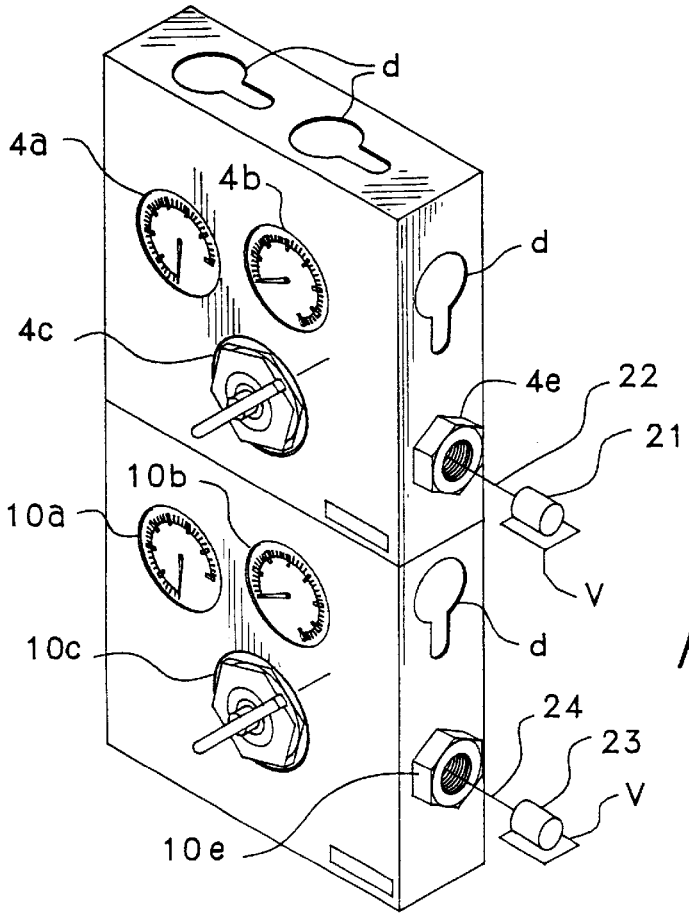
FIG. 1 is a perspective view of the regulator protector with flexible lines and cylinders shown schematically.

The regulator protector shown has a housing assembly including a cover or case 1 and a back wall 3 made as a separate part from the cover 1. The cover has a front wall F, top wall T, and opposed side walls S and is open along the back. The back wall 3 has a raised, flat plate 3*a* with opposed top and bottom mounting flanges 3*b* and 3*c* with holes 3*d* in the flanges that receive fasteners F such as bolts to attach the housing to a support SS on a suitable transport vehicle V such as a trailer box or trailer. A bolt 6 with external threads is affixed to the raised plate 3*a* and extends through an aperture 9 in the cover 1 so the back wall 3 nests in the cover 1 and is fastened thereto by a nut 7 threaded on the bolt 6.

The oxygen regulator 4 has a cylinder pressure gauge 4*a* and working pressure gauge 4*b* mounted on a valve body 4*c* having an adjusting screw lever 4*f* along the front for adjusting the working pressure, a rigid inlet flow line 4*d* connected into the valve body 4*c* with a connector or fitting 4*e* shown as a male fitting. Fitting 4*e* is used to fasten the regulator directly to the top of the cylinder during the normal use of the regulator and cylinder.

The front wall F of the cover 1 has a first hole 1*a* positioned to be in register with the cylinder pressure gauge 4*a*, a second hole l*b* positioned to be in register with working pressure gauge 4*b*, and a third hole 1*c* positioned to be in register with valve body 4*c*. A resilient means in the form of a rubber grommet 2 fits around the valve body 4*c* and in hole 1*c* which serves as a cushion to reduce vibration and wear.

A U-shaped opening 1*e* that opens along the back edge of the side wall is provided in the side wall to allow the flexible flow line or hose 22 to extend through and connect to the oxygen cylinder 21. The cover has three keyhole openings 1*d*. Two openings 1*d* are in the top wall and one is in the side wall to receive the free end of the flexible hose 22 when the hose is not connected to cylinder 21. A holder 15 is fastened on the back wall and has a base section 15*a* secured to the wall and a C-shaped section 15*b* sized to fit around the cylinder valve body to index or locate the regulator 4 in the correct position on the back wall 3.

A fuel gas regulator 10 shown has a cylinder pressure gauge 10*a*, a working pressure gauge 10*b* mounted to the valve body 10*c* having an adjusting screw lever 10*f* at the front for adjusting the working pressure, and a rigid inlet line 10*d* connected to the valve body 10*c* with a connector or fitting 10*e* shown as a female fitting. The fitting 10*e* is used to fasten the regulator to the top of the fuel gas cylinder during the normal use of the gas cylinder. The front wall of the cover has a fifth hole positioned to be in register with the cylinder pressure gauge 10*a*, a sixth hole positioned to be in register with the working pressure gauge 10*b*, and a seventh hole positioned to be in register with the valve body 10*c*. A rubber grommet 2 fits in the hole and around the valve body and serves to cushion the valve body to reduce vibration.

The holder 15 is fastened on the back wall and has a base section 15*c* secured to the back wall 3 and a C-shaped section 15*d* sized to fit around the valve body 10*c* to index or locate the regulator 10 in the correct position in the back wall.

In use, the regulators 4 and 10 are carried in the regulator protector housing located preferably 3 to 4 feet from the cylinders. The cylinders are connected to the regulators by the flexible lines 22 and 24. Referring to FIG. 1 the oxygen cylinder 21 and flexible flow line 22 are shown schematically as connected to the line 4*d* of regulator 4 and the fuel cylinder 23 and flexible flow line 24 are shown schematically as connected to the line 10*d* of regulator 10.

Figure 3:
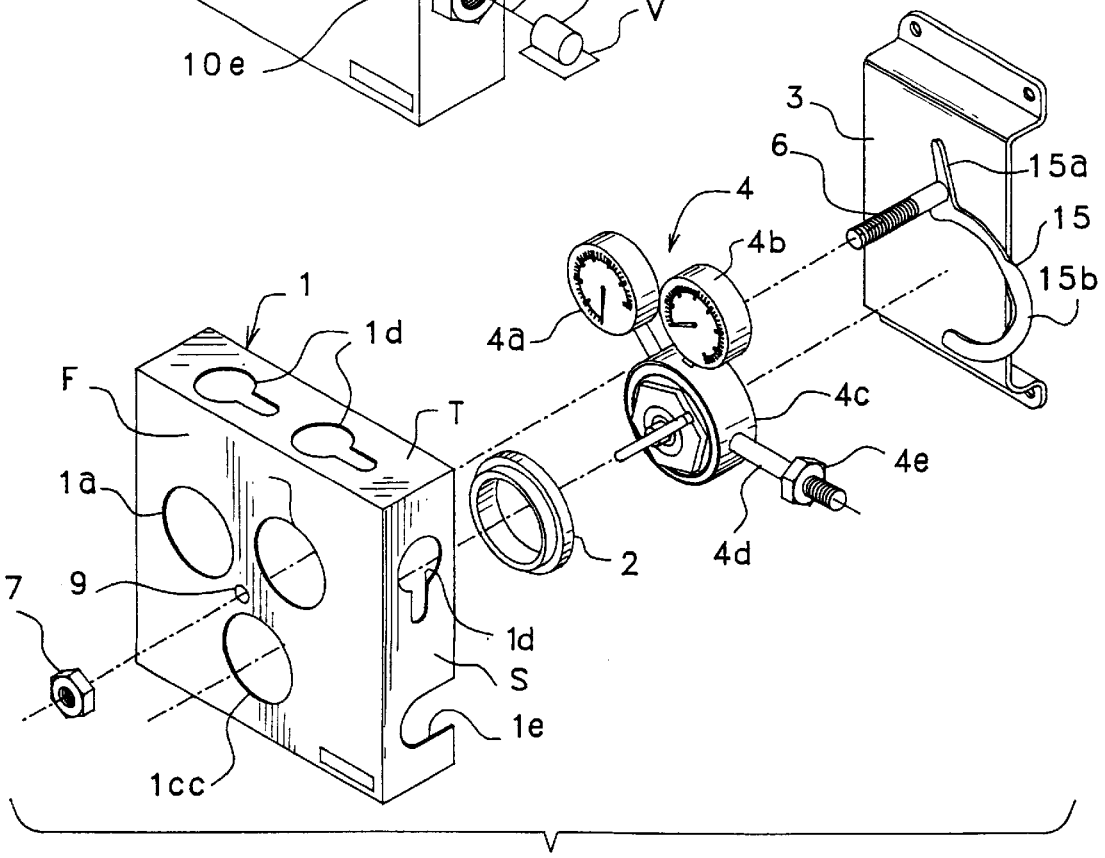
FIG. 3 is an exploded perspective view of the regulator protector for a single pressurized tank which may be either an oxygen cylinder or fuel cylinder only.
Figure 2:
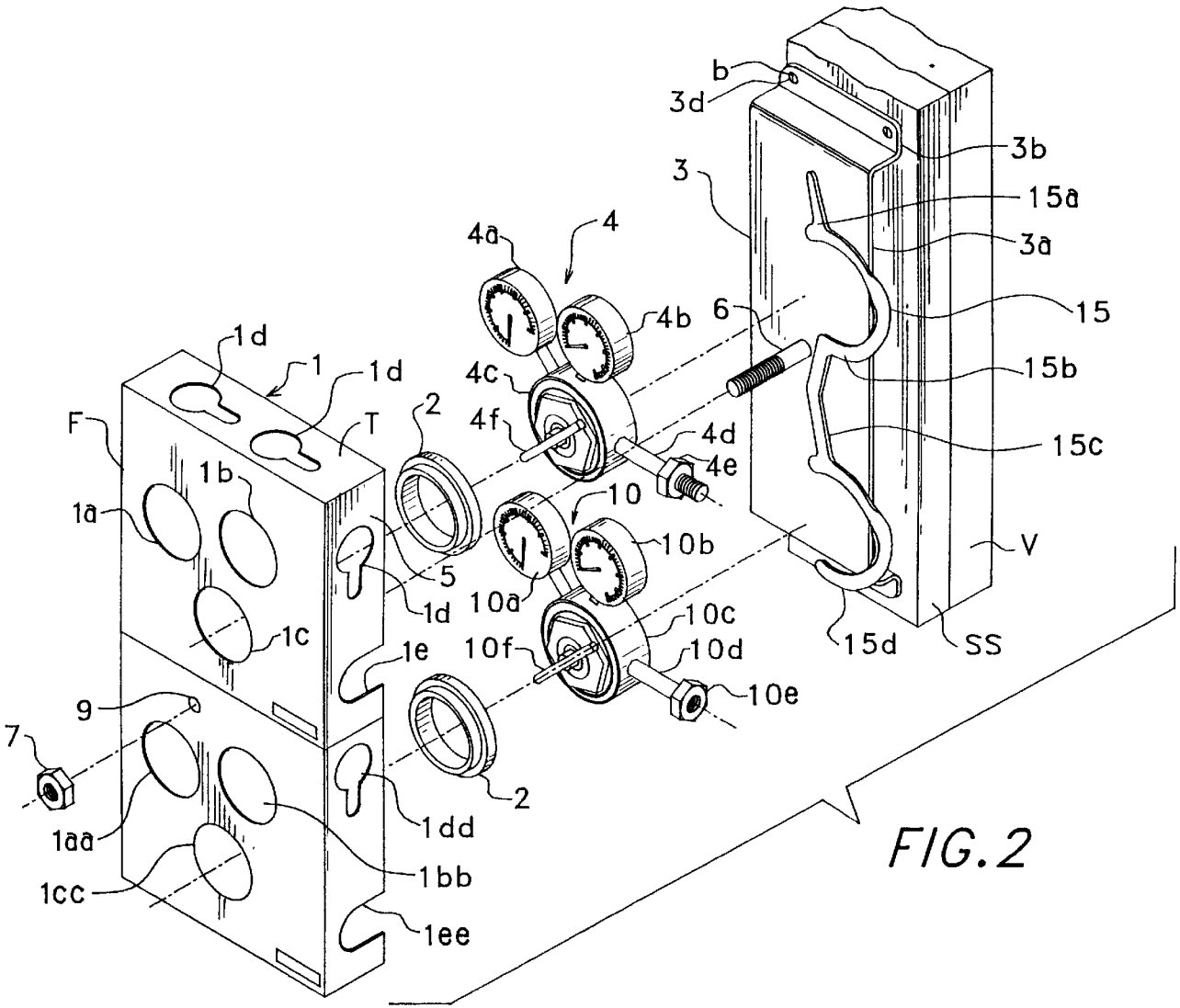
FIG. 2 is an exploded perspective view of the regulator protector suitable for both an oxygen cylinder and fuel gas cylinder with the support and transport vehicle shown schematically.

Referring now to FIG. 3 only the top portion of the housing 1 is shown to accommodate only one cylinder with the same parts bearing the same reference numerals. Thus the housing can be operated for one or more regulators. When it is properly attached, bolted or welded to a transport vehicle such as a truck or trailer, the chances of explosion or fire will be greatly reduced.

Although the present invention has been described with a certain degree of particularity, it is understood that the present disclosure has been made by way of example and that changes in details of structure may be made without departing from the spirit thereof.

What is claimed is:

1. A regulator protector for a pressurized tank carried on a transport vehicle during transport comprising:

a housing having mounting means to fasten said housing to a support on a transport vehicle, a regulator mounted in said housing having a tank pressure gauge located in a first hole in said housing, a working pressure gauge located in a second hole in said housing, a pressure valve body located in a third hole in said housing, an inlet flow line with a fitting that is adapted to fasten to the top of said pressurized tank during normal use, and an elongated connecting flow line connected to said fitting and extending through a fourth hole in said housing and connected to a pressurized tank supported on said transport vehicle a distance from said housing.

2. The protector as set forth in claim 1 wherein said housing includes a cover having a front wall, top wall and opposed side walls, said cover being open along the back and a back wall nested in said cover and separable from said cover.

3. The protector as set forth in claim 2 wherein said back wall has a raised flat plate portion with opposed mounting flanges having holes to receive fasteners.

4. The protector as set forth in claim 2 including a holder on said back wall to locate said regulator at a particular position on said back wall.

5. The protector as set forth in claim 4 wherein said holder has a base section secured to said back wall and a C-shaped section sized to fit around a valve body.

6. The protector as set forth in claim 1 including resilient means between said regulator and said housing to cushion said regulator to reduce vibration and wear.

7. The protector as set forth in claim 6 wherein said resilient means is in the form of a rubber grommet.

8. The protector as set forth in claim 1 including a second regulator in said housing, second regulator having a second tank pressure gauge in a fifth hole in said housing, a second working pressure gauge in a sixth hole in said housing, a second pressure control valve body in a seventh hole in said housing, a second inlet flow line extending through an eighth hole in said housing and having a second fitting adapted to fasten directly to the top of a second pressurized tank during normal usage, said second fitting connecting to a second elongated connecting flow line for connecting to a second pressurized tank supported on the transport vehicle a distance from said housing.

9. The protector as set forth in claim 1 including a hole in a side wall of said housing through which said flow line extends.

10. The protector as set forth in claim 9 wherein said connecting flow line is a flexible hose approximately three to four feet in length.

11. The protector as set forth in claim 2 wherein said fourth hole is U-shaped and opens along the back edge of one of said side walls.

12. The protector as set forth in claim 2 including a pair of holes of a key-hole shape in said top wall to receive an end of said flow line to support said flow line when not connected to said pressurized tank.

13. The protector as set forth in claim 2 including an opening in one of said side walls to receive an end of said connecting flow line to support said connecting flow line when not connected to said pressurized tank.

14. The protector as set forth in claim 2 wherein said back wall has a bolt with external threads that extends through a hole in said cover with a nut threaded on said bolt to fasten said cover to said back wall.

15. A regulator protector for a pressurized tank carried on a transport vehicle during transport comprising:

a housing having mounting means to fasten said housing to a support on a transport vehicle, said housing including a cover having a front wall, top wall and opposed side walls, said cover being open along the back and a back wall nested in said cover and separable from said cover, said back wall having a raised flat plate portion with opposed mounting flanges having holes to receive fasteners, said back wall having a bolt with external threads that extends through a hole in said cover with a nut threaded on said bolt to fasten said cover to said back wall, a regulator mounted in said housing having a tank pressure gauge located in a first hole in said housing, a working pressure gauge located in a second hole in said housing, a pressure valve body located in a third hole in said housing, an inlet flow line with a fitting that is adapted to fasten to the top of said pressurized tank during normal use, and an elongated connecting flow line connected to said fitting and extending through a fourth hole in said housing and connected to a pressurized tank supported on said transport vehicle a distance from said housing.

16. A regulator protector for an oxygen tank and a fuel tank carried on a transport vehicle during transport comprising:

a housing assembly including a cover having a front wall, a top wall, opposed side walls and a back wall separable from said cover, said back wall having means to rigidly fasten said housing to a support on a transport vehicle, an oxygen regulator mounted in said housing assembly having a cylinder pressure gauge in register with a first hole in said front wall, a working pressure gauge in register with a second hole in said front wall, a first pressure control valve body in register with a third hole in said front wall, a first inlet flow line with a fitting that is adapted to fasten directly to the top of an oxygen tank during normal use, said inlet flow line extending through a fourth hole in said side wall, said fitting connecting to a flexible flow line for connecting to an oxygen tank supported on the transport vehicle a distance from said housing assembly, a fuel regulator in said housing having a second cylinder pressure gauge in a fifth hole in said front wall, a second working pressure gauge in a sixth hole in said front wall, a second pressure control valve body in a seventh hole in said front wall, a second inlet flow line extending through an eighth hole in said side wall and having a second fitting adapted to fasten directly to the top of the fuel tank during normal usage, said second fitting connecting to a second flexible flow line for connecting to the fuel tank supported on the transport vehicle a distance from said housing assembly.

* * * * *